US009046263B2

(12) United States Patent
Haynes

(10) Patent No.: US 9,046,263 B2
(45) Date of Patent: Jun. 2, 2015

(54) CYCLONIC BURNER WITH SEPARATION PLATE IN THE COMBUSTION CHAMBER

(76) Inventor: Harold Haynes, Airdrie (CA)

( * ) Notice: Subject to any disclaimer, the term of this patent is extended or adjusted under 35 U.S.C. 154(b) by 635 days.

(21) Appl. No.: 13/261,143

(22) PCT Filed: Jul. 8, 2010

(86) PCT No.: PCT/CA2010/001043

§ 371 (c)(1),
(2), (4) Date: Jan. 13, 2012

(87) PCT Pub. No.: WO2011/006235

PCT Pub. Date: Jan. 20, 2011

(65) Prior Publication Data

US 2012/0148964 A1 Jun. 14, 2012

Related U.S. Application Data

(60) Provisional application No. 61/225,528, filed on Jul. 14, 2009.

(51) Int. Cl.

| | |
|---|---|
| ***F23D 3/00*** | (2006.01) |
| ***F23C 3/00*** | (2006.01) |
| ***F23C 7/00*** | (2006.01) |

(52) U.S. Cl.

CPC ..... *F23C 3/006* (2013.01); *F23C 7/002* (2013.01)

(58) Field of Classification Search

CPC ..... F23C 3/008; F23D 11/08
USPC ..... 431/171, 173, 8, 10, 201; 122/40
See application file for complete search history.

(56) References Cited

U.S. PATENT DOCUMENTS

| | | | | | |
|---|---|---|---|---|---|
| 1,639,202 | A | * | 8/1927 | Valjean | 431/10 |
| 2,800,091 | A | * | 7/1957 | Lotz et al. | 110/264 |
| 2,855,873 | A | * | 10/1958 | Von Swietochowski | 110/266 |
| 3,199,476 | A | * | 8/1965 | Nettel | 110/265 |
| 4,021,188 | A | * | 5/1977 | Yamagishi et al. | 431/158 |
| 4,257,760 | A | * | 3/1981 | Schuurman et al. | 431/158 |
| 5,697,776 | A | * | 12/1997 | Van Eerden et al. | 431/348 |
| 5,722,588 | A | * | 3/1998 | Inoue et al. | 237/12.3 C |
| 2007/0256661 | A1 | * | 11/2007 | Smith | 123/254 |

* cited by examiner

*Primary Examiner* — Steven B McAllister
*Assistant Examiner* — Rabeeul Zuberi
(74) *Attorney, Agent, or Firm* — George A. Seaby

(57) ABSTRACT

A method and apparatus for burning fuel are described In a conventional boiler the combustion process produces particles which form a layer of deposits on boiler tubes, thus reducing heat transfer efficiency A fuel burner (100) includes a casing, a combustion chamber (106), a tangential gas inlet (108), a fuel delivery system (112) and an exhaust port (114) The casing includes a lower wall (102), an upper wall (104) and a cylindrical side wall (105) formed between the lower and upper walls (102, 104) and encloses the combustion chamber (106) The tangential gas inlet (108) is formed in the cylindrical wall (105) of the combustion chamber (106) The fuel delivery system (112) is configured to deliver fuel into the tangential air inlet (108) The exhaust port (114) is formed in the upper wall (104) of the combustion chamber (106) Gas is delivered into the combustion chamber (106) at a velocity and flow rate and mixes with fuel delivered from the fuel delivery system (112), such that a clean flame burns in the combustion chamber (106) A clean flame is a flame substantially free of unburned particulate matter.

14 Claims, 10 Drawing Sheets

CYCLONIC BURNER WITH SEPARATION PLATE IN THE COMBUSTION CHAMBER

CROSS REFERENCE TO RELATED APPLICATION

This application claims tho benefit of U.S. Provisional Application Ser No. 61/225,528, filed Jul. 14, 2009, titled "CYCLONIC BURNER WITH SEPARATION PLATE IN THE COMBUSTION CHAMBER" the entire contents of wrucn are hereby incorporated by reference.

TECHNICAL FIELD

This invention relates to a method and apparatus for burning fuel.

BACKGROUND

A conventional boiler uses the combustion of a fuel, such as wood, coal, oil or natural gas, to generate a flame that burns within the boiler's firebox. Generally, the fuel burning mechanism sits outside the firebox and the flame is directed into the firebox. The flame is usually a yellow or orange flame and the combustion process produces particles of incandescent carbon in the exhaust gas stream. These particles can create carbon deposits on the boiler tubes and flues providing an undesirable insulating layer that can greatly reduce boiler efficiency. The boiler is but one example of burner applications where particles in the exhaust gas due to inefficient fuel burning yield undesirable effects.

SUMMARY

This invention relates to a method and apparatus for burning fuel. In general, in one aspect, the invention features a burner including a casing, a combustion chamber, a tangential gas inlet, a fuel delivery system and an exhaust port. The casing includes a lower wall, an upper wall and a cylindrical side wall formed between the lower and upper walls and encloses the combustion chamber. The tangential gas inlet is formed in the cylindrical wall of the combustion chamber. The fuel delivery system is configured to deliver fuel into the tangential air inlet. The exhaust port is formed in the upper wall of the combustion chamber. Gas is delivered into the combustion chamber at a velocity and flow rate and mixes with fuel delivered from the fuel delivery system, such that a clean flame burns in the combustion chamber. A clean flame is a flame substantially free of unburned particulate matter.

Implementations of the invention can include one or more of the following features. The fuel delivery system can be configured to deliver fuel into a gas stream in the tangential gas inlet upstream of a gas entrance into the combustion chamber. The exhaust port can include a sleeve extending substantially perpendicularly relative to the upper wall of the combustion chamber. A width of the combustion chamber can be at least two times a height of the combustion chamber. A width of the exhaust port can be in the range of approximately ¼ to ⅓ a diameter of the combustion chamber. The fuel delivery system can include a nozzle to spray the fuel into the tangential inlet. The burner can further include a second fuel delivery system configured to deliver a primary fuel downstream of the fuel delivered by the fuel delivery system, where the fuel delivered by the fuel delivery system is a pilot fuel. The primary fuel can be gravity fed into the combustion chamber and the second fuel delivery system can be a conveying system. The gas delivered into the combustion chamber can be air.

In general, in another aspect, the invention features a method of burning fuel. The method includes introducing a fuel into a tangential gas inlet formed in a cylindrical wall of a casing of a burner. The casing includes a lower wall, an upper wall, and the cylindrical side wall formed between the lower and upper walls to enclose a combustion chamber and an exhaust port formed in the upper wall. Fuel is introduced into a gas stream in the air inlet upstream of an entrance into the combustion chamber. The method further includes delivering gas into the combustion chamber through the tangential gas inlet to mix with the fuel. The gas is delivered at such a velocity and flow rate that a clean flame burns in the combustion chamber, the clean flame being substantially free of any unburned particulate matter.

In some implementations, the method can further include delivering a primary fuel into the combustion chamber downstream of the fuel, in instances where the fuel is a pilot fuel.

In general, in another aspect, the invention features a boiler. The boiler includes multiple boiler tubes in fluid communication with a firebox, the firebox, and a burner contained within the firebox. The burner includes a casing having a lower wall, an upper wall and a cylindrical side wall formed between the lower and upper walls to enclose a combustion chamber. The burner further includes: a tangential gas inlet formed in the cylindrical wall of the combustion chamber; a fuel delivery system configured to deliver fuel into the tangential gas inlet; and an exhaust port formed in the upper wall of the combustion chamber. Gas is delivered into the combustion chamber at a velocity and flow rate and mixes with fuel delivered from the fuel delivery system, such that a clean flame substantially free of any unburned particulate matter burns in the combustion chamber. Radiant heat from the burner heats the firebox and exhaust gas expelled from the exhaust port provides convection heat to the boiler tubes.

In general, in another aspect, the invention features a burner including a combustion chamber, a tangential gas inlet, a fuel delivery system and an exhaust port. The combustion chamber includes: a lower wall, an upper wall, a cylindrical side wall formed between the lower and upper walls to enclose the combustion chamber, and a plate separating the combustion chamber into a lower chamber and an upper chamber. An annular gap is provided between the plate and the cylindrical wall providing communication between the lower and upper chambers. The tangential gas inlet is formed in the cylindrical wall of the combustion chamber. The fuel delivery system is configured to deliver fuel into the tangential gas inlet. The exhaust port is formed in the upper wall of the combustion chamber.

Implementations of the burner can include one or more of the following features. The gas can be delivered into the combustion chamber at a velocity and flow rate and mix with fuel delivered from the fuel delivery system, such that a clean flame substantially free of unburned particulates burns in the combustion chamber. The tangential gas inlet can terminate in an air entrance into the lower chamber. The plate can be suspended from the upper wall of the combustion chamber, or the plate can be supported by one or more support members extending to the lower wall of the combustion chamber.

The plate can include one or more apertures, each aperture in fluid communication with a gas supply and wherein gas is provided to the combustion chamber through the one or more apertures. The gas can be air. The apertures can be formed in an upper surface of the plate and gas can be provided into the upper chamber of the combustion chamber and/or the apertures can be formed in a lower surface of the plate and gas can be provided into the lower chamber of the combustion chamber. The apertures can be formed in an edge of the plate facing the cylindrical wall of the combustion chamber and gas can be provided into the annular gap between the plate and the cylindrical wall.

Gas directing members can be positioned on the plate under or over each of the one or more apertures, where the gas directing members provide a channel with an outlet to direct the flow of gas from the apertures into the combustion chamber. A gas directing member can include a first component extending substantially perpendicular to the plate and a second component extending substantially parallel to the plate, where a distal end of the second component comprises the outlet. The burner can further include a second plate positioned between the plate and the lower wall of the combustion chamber, with an annular gap between the second plate and the cylindrical wall. The second plate can separate the lower chamber into a first lower chamber and a second lower chamber.

Implementations of the invention can realize one or more of the following advantages. The burner provides both radiant heat and heated exhaust gases. The radiant heat emitted from the burner can be estimated and therefore controlled by controlling the dimensions of the burner and/or operating parameters. Placing the burner within the firebox of a boiler, for example, provides for improved heat management and boiler efficiency. The clean flame burning within the burner provides for substantially clean exhaust gases, and therefore less harmful emissions. In the boiler application, this can mean improved boiler efficiency and less boiler down-time to remove carbon build-up from boiler tubes and flues, as required by a conventional burner unit. The burner can be configured to burn oil sands products as a fuel. Using the burner within a boiler used for steam assisted bitumen recovery from an oil sands reservoir can be particularly efficient when using readily available oil sands products as a fuel feedstock, and avoiding the use of more expensive natural gas as the major fuel for steam generation.

Another advantage is the opportunity to exploit less expensive available fuel feedstock, even a feedstock still contained in the oil sands prior to any treatment or processing. Another advantage is the ability to switch to a different fuel on an almost instant basis. This can be particularly advantageous with fuel prices constantly changing. For example, the price differential between natural gas and oil fluctuates considerably, which can be strong motivator in selecting a fuel type. As prices change, the fuel type can be changed accordingly to minimize fuel costs.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
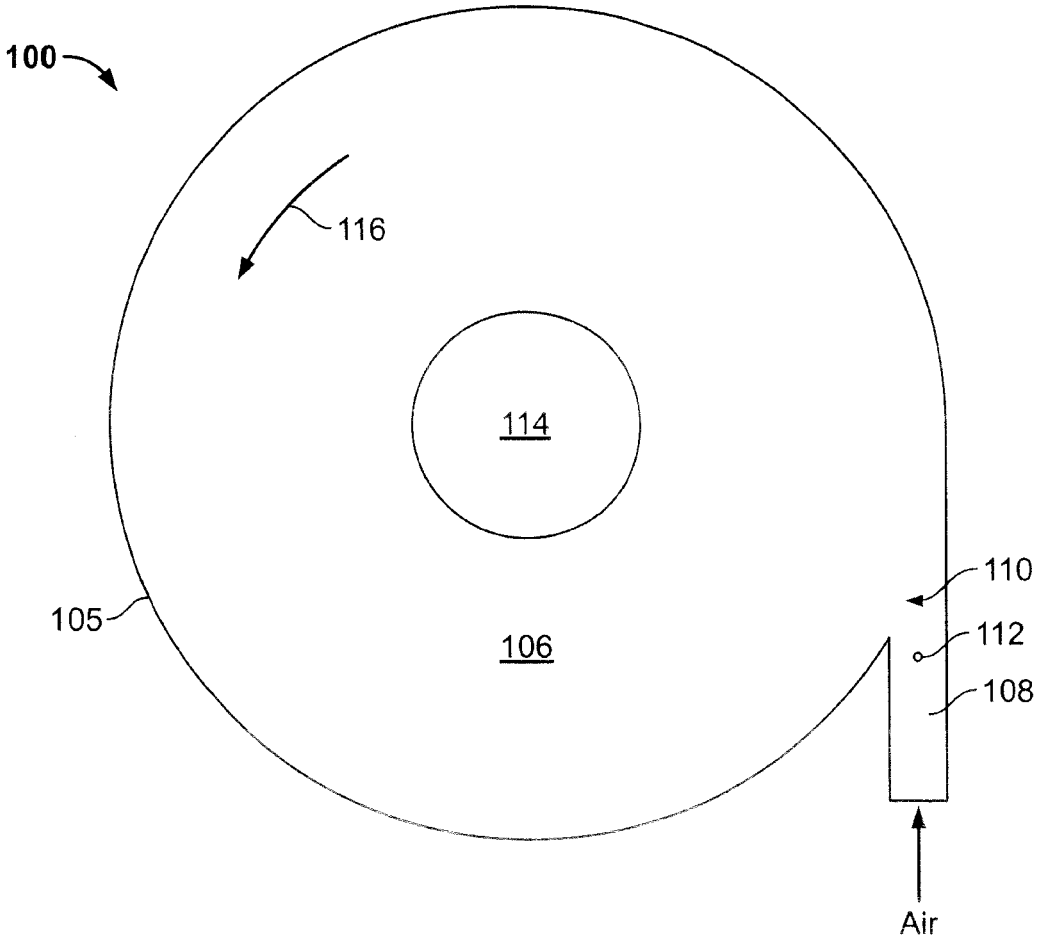
FIG. 1A is a plan view of an example burner.
Figure 1B:
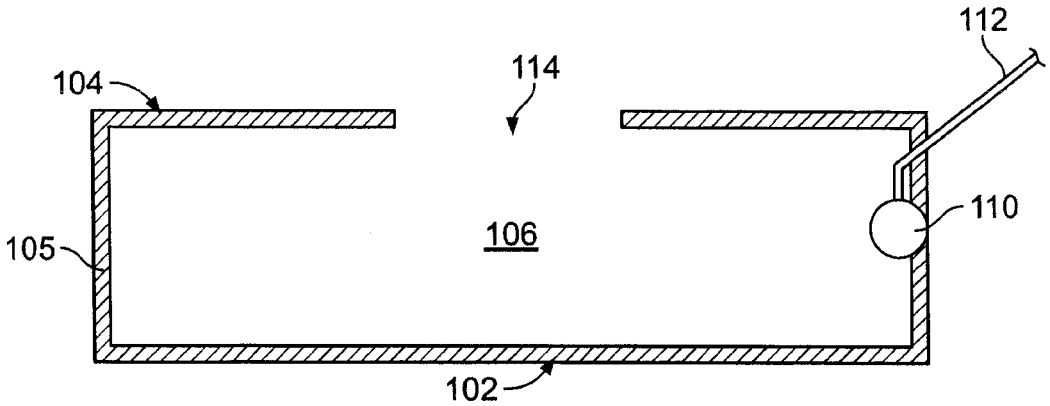
FIG. 1B is a cross-sectional side view of the burner of FIG. 1A.

Methods and apparatus for burning a fuel are described wherein burn efficiency is enhanced such that exhaust gases are substantially free of particulates. Referring to FIGS. 1A and 1B, one example embodiment of a burner 100 is shown; FIG. 1A shows a plan view and FIG. 1B shows a cross-sectional front view. The burner has a casing including a lower wall 102, an upper wall 104 and a cylindrical side wall 105 formed between the lower and upper walls to enclose a combustion chamber 106. The burner 100 includes a gas inlet 108. In this implementation, the gas inlet 108 is a tangential air inlet terminating at an air entrance 110 into the combustion chamber. A fuel delivery system 112 is positioned to deliver fuel into the air stream within the air inlet and upstream of the air entrance 110. In other implementations, the fuel delivery system can be positioned downstream of the air entrance 110. An exhaust port 114 is formed in the upper wall 104 of the burner 100. Although in the particular implementation described, air is input into the burner through the gas inlet 108, it should be understood that pure oxygen or another gas mixture with some content of oxygen can be used instead, and air is but one example of the inlet gas for illustrative purposes.

The cylindrical shape of the combustion chamber 106 provides an intimate sustained containment of the fuel-air mixture and the mixture can circulate repeatedly around the interior of the combustion chamber before exhausting. The air stream input into the combustion chamber 106 through the gas inlet 108 provides oxygen for substantially complete combustion of the fuel, but also provides sufficient kinetic energy such that adequate mixing and turbulence within the combustion chamber 106 is achieved. The fuel can be substantially, if not completely, vaporized within the combustion chamber 106. The cylindrical shape of the combustion chamber 106 allows the flame to be re-circulated and recycled, such that the increased residence time promotes complete combustion of the fuel, i.e., a clean burn.

The air is delivered into the combustion chamber 106 with a direction, volume, pressure and velocity such that the fuel burns with a clean flame that is substantially free of unburned fuel. The clean flame is typically characterized by a blue flame resembling a blue plasma, that substantially fills the combustion chamber with a comparatively small crown of blue flame evident at the exhaust port. That is, a typical orange or yellow flame is indicative of unburned fuel, that is, unburned incandescent particles of fuel or carbon within the flame. However, if combustion of the fuel is complete (or substantially complete), the flame burns blue. The blue color of the flame is indicative of complete or substantially complete fuel combustion, i.e., a "clean flame". In some implementations, it is desirable to achieve a clean flame at a lowest possible temperature. For example, although a blue/clean flame can be achieved from an oxy-acetylene torch, the temperature of the flame is approximately 5500° Celsius, which can be destructive to the burner 100, or require the use of appropriate heat resistant material in the construction of the burner. The temperature required to achieve a clean flame can vary depending on the fuel being burned, however, in some implementations, a clean flame has been achieved at approximately 800° Celsius.

The operating parameters, such as, volume, pressure and velocity, required to achieve the clean flame can be obtained empirically through experimentation and can vary with varying burner configurations and dimensions. The air volume can be extrapolated based on the manufacturer's specifications of a blower used to blow the air into the burner. The pressure can be measured at one or more points, for example, with a water tube nanometer. The pressure measuring device(s) can be positioned in various locations, including: in a primary air supply tube ahead of the burner entrance; in the periphery (outside edge) of the combustion chamber to measure pressure in this high velocity region; and/or near the center of the combustion chamber to measure pressure close to the center of the flame inside the burner, which pressure can be compared to pressures measured at the other locations. Such pressure readings will typically be above normal atmospheric pressure and can represent the addition of energy to the air stream and the effects of fuel combustion.

The velocity can be determined (or at least estimated) based on a measuring instrument gauging the velocity of air in the burner before being lit and then a factor added for the volumetric increase when the flame is burning. Operating parameters can be adjusted until the flame switches from an orange/yellow flame to a blue flame indicating a clean burn. The volume, pressure and velocity required to achieve the clean flame can be recorded. In other implementations, the volume, pressure and velocity required to achieve the clean flame can be determined by modeling, e.g., computer modeling.

The tangential gas inlet 108 produces an air pattern within the combustion chamber 106 that effectively punches a "round hole" (in the case of a round air inlet) of high velocity air into the fuel-air mixture already in the combustion chamber 106. This plug of high velocity air rapidly flattens out against the inner surface of the cylindrical side wall 105 and provides continuous acceleration of the air content within the combustion chamber 106. The highest air pressure is against the periphery of the burner casing, with a somewhat lower pressure at the centre of the combustion chamber 106. The fuel delivered into the air stream, e.g., by gravity or spray, is forced by centrifugal action against the hot interior faces of the casing where the fuel is rapidly brought up to combustion temperature and substantially vaporized and mixed with the entraining air.

Visual observations of some implementations have shown the flame to make approximately 6-8 complete revolutions inside the combustion chamber 105 with the high speed flame concentrated in a "dense" layer around the inner face of the cylindrical wall 105, as can be indicated during experimentation by glowing incombustible particles (e.g., bits of steel, welding slag and/or grindings). For example, the velocity can be in the order of approximately 40 feet per second. It should be understood that different implementations may exhibit different behavior and the above is intended as an illustrative example.

The residence time, recycling and recirculation of the flame and fuel within the confined and contained space of the combustion chamber are operating parameters that can achieve the clean burn and generate a clean, blue flame with complete combustion of the fuel. That is, being able to contain the flame and adjust the residence time can achieve a clean flame. The residence time can be adjusted to suit a particular application and fuel being used, for example, by changing the height and diameter of the burner and/or by using one or more plates to separate the interior of the burner into two or more combustion chambers.

To achieve a relatively easy start-up and stable combustion, a balance can be achieved between the temperature of the casing, such that it is sufficiently hot for good fuel vaporization, and the cooling effect of the combustion air entering the combustion chamber 106.

When the burner is operating at clean flame conditions, the temperature within the combustion chamber in some implementations (e.g., depending on the fuel burned), can be approximately 800° C. In an embodiment where the surfaces and walls of the burner are made from steel, the temperature of the steel during clean flame operating conditions can be in the range of approximately 650° C. to 760° C. with the casing glowing a dull red, to as high as approximately 1200° C. with the casing glowing a bright cherry red, emitting radiant heat. The temperature of the casing varies with the amount of fuel burned within the combustion chamber over a certain time span. As the fuel swirls within the combustion chamber by centrifugal force, any unburned fuel coming into contact with the inner walls of the combustion chamber 106 is vaporized.

In the embodiment shown in FIGS. 1A and 1B, the exhaust port 114 has a circular shape and is formed in the upper wall 104 of the burner 100. In some examples, the diameter of the exhaust port 114 can be approximately ¼ to ⅓ the diameter of the combustion chamber 106. The exhaust port 114 can include a sleeve inserted into the port opening. The sleeve can alter the aerodynamics of the combustion process. For example, in some implementations, the sleeve can extend down into the combustion chamber 106, which can increase the pressure within the chamber. In other implementations, the sleeve can extend up from the upper wall 104, which can provide an exhaust stack effect that can increase the velocity of the flame within the chamber. In other implementations, the sleeve can extend both down into the chamber and up from the upper wall. Preferably the exhaust port is circular and centered. In some implementations, the exhaust port can be formed in the lower wall 102 of the casing rather than the upper wall 104.

In some implementations, the fuel delivery system 112 can drip feed a liquid fuel into the air inlet. Examples of fuel include, but are not limited to, diesel, #6 fuel oil, canola oil, propane, natural gas, and biofuels or any combination of these or other fuels. It is possible, and in some instances desirable from an availability and/or fuel cost perspective, to switch fuels without shutting down or reconfiguring the burner. This ease of fuel switching can be particularly advantageous for certain potential applications of the burner, such as combined cycle electrical power generation, or in a residential heating application.

In other implementations, the fuel delivery system 112 can include a nozzle that sprays the fuel into the air stream. A metered fuel delivery system can be used, for example, where the fuel is introduced through a fixed displacement pump and the volume of fuel is constant for any given pump RPM (revolutions per minute) and nozzle size. In another example, fuel delivery can be ultrasonic where extremely fine atomization is achieved and the fuel/water blending can be at a ratio of, in one example, 30% water and 70% fuel. Other fuel delivery systems are possible, and these are but a few examples.

In some implementations, the burner 100 can include a second fuel delivery system positioned and configured to deliver a primary fuel into the combustion chamber downstream of the fuel delivery system 112, which can be used to deliver a pilot fuel. That is, the initial fuel delivered by the fuel delivery system 112 can function as a pilot fuel, with the primary fuel providing the majority of the heating value. By way of example, in some implementations, the primary fuel can be a heavy end product extracted from oil sands, for example, coke or bitumen. In other implementations, the primary fuel can be an Orimulsion or can be MSAR fuel available from Quadrise Canada Corporation of Calgary, Canada. This can be advantageous, particularly if the burner is used to produce steam for a steam assisted operation to recover heavy oil or bitumen from the oil sands, as is described in further detail below.

Figure 2:
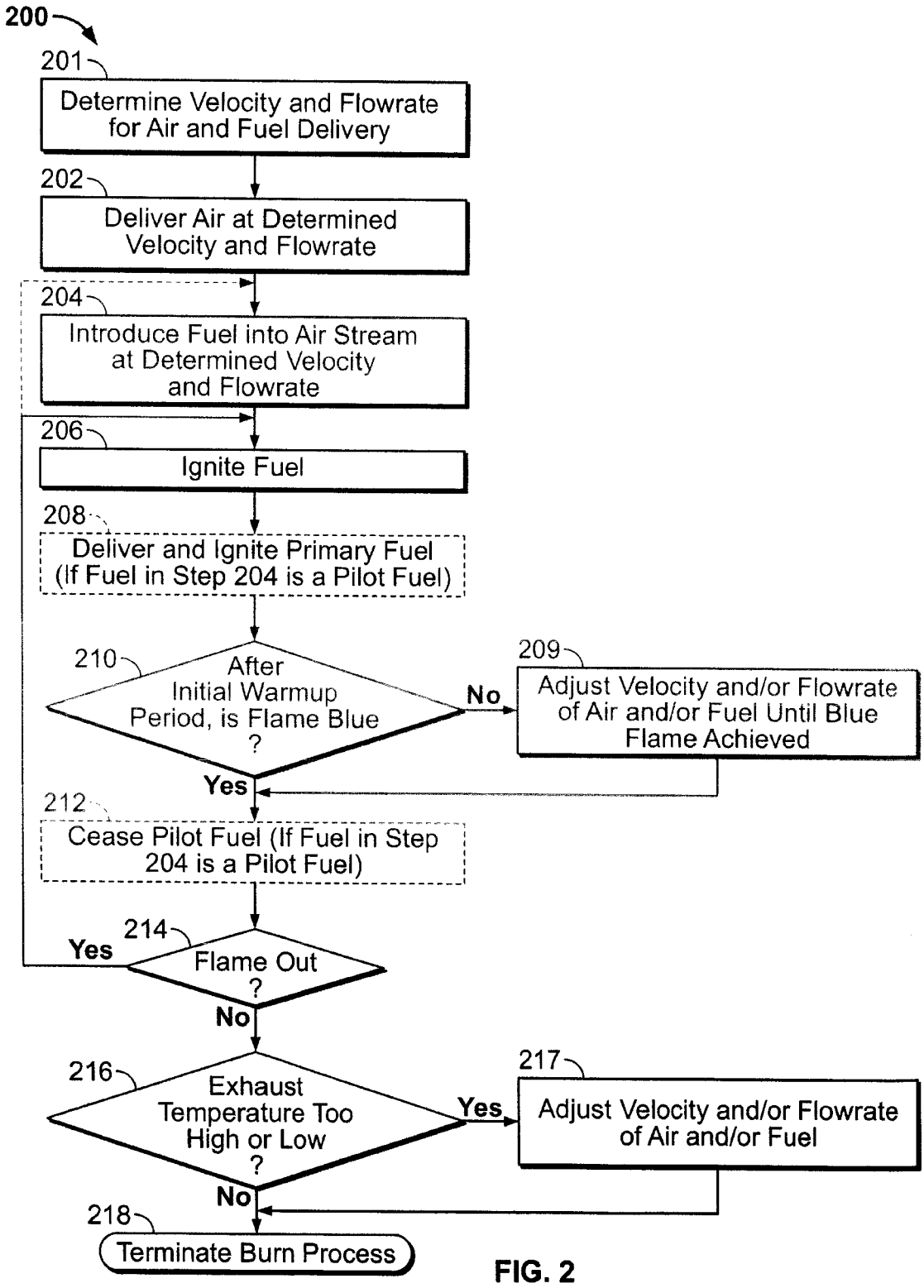
FIG. 2 is a flowchart showing an example process for using a burner.

Referring to FIG. 2, a flowchart shows an example process 200 for burning a fuel with reduced emissions. For illustrative purposes, the process 200 is described using the burner 100 shown in FIGS. 1A and 1B, although it should be understood that other configurations of burner can be used, for example, different implementations described further below. The velocity and flow rate at which the gas, air in this example, will be delivered into the combustion chamber is determined (Step 201). The velocity and flow rate are determined so that enough oxygen is present in the combustion chamber for a substantially complete and clean burn of the fuel without excess air, and are determined to provide sufficient kinetic energy so that adequate mixing and turbulence is achieved within the combustion chamber.

The air is delivered into the combustion chamber 106 through the gas inlet 108 at the determined velocity and flow rate (Step 202). Fuel is introduced into the air stream upstream of the air entrance 110 into the combustion chamber using the fuel delivery system 112 (Step 204). For example, the fuel can be drip fed or sprayed through a nozzle into the air stream. The fuel is ignited to initiate the fuel burn process (Step 206). In one implementation, a spark igniter can be used. For example, two electrodes can be positioned just downstream of the fuel being delivered into the air inlet and a spark across the gap between the two electrodes can ignite the fuel. Other sources or configurations of ignition can be used, e.g., a heated wire element mounted on ceramic posts.

In an implementation including a second fuel delivery system for delivery of a primary fuel, the primary fuel can be delivered into the combustion chamber 106, preferably before the clean flame is achieved (Step 208). In such an implementation, the fuel delivered by the fuel delivery system 112 is a pilot fuel.

After an initial warm-up period expires, a determination is made that a clean flame has been achieved ("Yes" branch of Step 210). For example, although a visual observation can provide a rough indication that a clean flame is achieved, e.g., the flame has turned to blue, in some implementations a flame sensor can be used. The sensor can provide a continuous feedback signal to a controller. In one example, the sensor can be an ultraviolet sensor. During clean flame operation, the ultraviolet sensor can be used and if the flame extinguishes, the sensor ceases generating a low voltage alarm current, which can then initiate a shutdown sequence. In some implementations, two sensors can be used and a shutdown sequence is only initiated if both sensors indicate the flame has extinguished. In addition to detecting a flame-out condition, the sensor can continuously measure the flame temperature, which can be transmitted to the controller providing information about the combustion conditions and the burner efficiency.

In a boiler implementation, a three point control system can be used that measures the burner, the FEGT (furnace exit gas temperature) and the boiler exit temperature. Referring to FIG. 6B, an illustrative example of a boiler implementation is shown. In some implementations, flame sensors can be positioned at some or all of the locations in the boiler 620 indicated by reference numerals 640, 642 and 644. A flame sensor at 640 can "look" vertically straight down into the centre of the burner. A flame sensor at 642 can "look" down at an angle into the interior periphery of the burner. A flame sensor at 644 can "see" the exterior crown of the flame. Other locations can be used, and the ones discussed are but a few examples.

In addition to a flame sensor, a stack gas instrument can be used to measure the emissions from the burner, which information can be provided to the controller. The emission measurements can be used to further determine adjustments to the operating parameters to achieve the clean flame.

Referring again to FIG. 2, if a clean flame is not present ("No" branch of Step 210), then one or more operating parameters can be adjusted until the clean flame is achieved. For example, the velocity and/or flow rate of the air and/or fuel being delivered into the combustion chamber can be adjusted. By way of illustration, if the flame is orange, the air flow can be increased or the fuel flow can be decreased. If the flame is orange and unstable, there may be too much air per fuel flow or the burner temperature may not yet be high enough for stable combustion. In another example, the fuel/air mixture can be modified and/or the residence time of the flame in the burner can be modified, such that the proper conditions for achieving the clean flame (i.e., a blue flame) are achieved.

If a clean flame is present ("Yes" branch of Step 210), then in implementations using an optional pilot fuel (i.e., where the fuel in step 206 is a pilot fuel), delivery of the pilot fuel can cease once the primary fuel is being delivered and burned in the combustion chamber 106 (Step 212). However, in some implementations, depending upon the combustion characteristics of the primary fuel, the pilot fuel may continue to be injected into the burner. The pilot fuel can be of a higher grade (e.g., lighter viscosity) than the primary fuel and therefore more expensive. As such, limiting the amount of pilot fuel required can be advantageous. Some non-limiting examples of a pilot fuel include natural gas, propane and diesel.

In some implementations, a sensor can be used to detect if the flame has extinguished, as was discussed above. If the sensor detects the flame is out ("Yes" branch of Step 214), then the process loops back to the step of delivering the pilot fuel (Step 204), if delivery had ceased, or else the process loops back to the ignition step (i.e., Step 206).

In some implementations, a sensor can be used, e.g., an ultraviolet temperature sensor, to detect the temperature of the exhaust gas. If the exhaust gas temperature is too high or too low for a particular application of the burner ("Yes" branch of Step 216), then one or more operating parameters, e.g., the velocity, air flow rate, and/or fuel flow rate, can be adjusted until the desired temperature is reached, while maintaining a clean flame. The process can continue until terminated, for example, by a human operator, timer, or other mechanism (Step 218).

The burner 100 can be formed from a material capable of withstanding relatively high temperatures, for example, approximately 800° C. Examples of materials include, but are not limited to, cast iron, steel including stainless steel, ceramic or ceramic-coated steel. Preferably, the width of the burner is greater than the height. For example, the ratio of the width to the height can be 3:1 or 4:1 in some implementations.

The dimensions of the burner 100 can vary, depending on the application. In one illustrative example, the burner has a 15 inch diameter and is 8 inches tall. The diameter of the exhaust port is 6⅝ inches and the walls of the burner are a ½ inch thick. Other dimensions are possible, and these are but one example.

In some implementations, ultrasonic mixing can be used to mix, blend and inject the primary fuel into the burner. This can be particularly useful if the primary fuel is a heavy fuel, e.g., heavy oil or bitumen. Ultrasonic blending of the fuel can provide a stable emulsion of mixed water and fuel that can facilitate providing efficient combustion and lower flame temperature. In one example, the blended fuel can be 70% fuel and 30% water. Ultrasonic injection nozzles are also advantageous because of their open-tube characteristics, their tendency not to plug and the extremely fine atomization that can be achieved, which facilitates complete carbon burnout. In some implementations, ultrasonic vibration of internal burner elements can be used, which may promote better combustion, as is described further below.

Multi-Chambered Burner Implementation

Figure 3A:
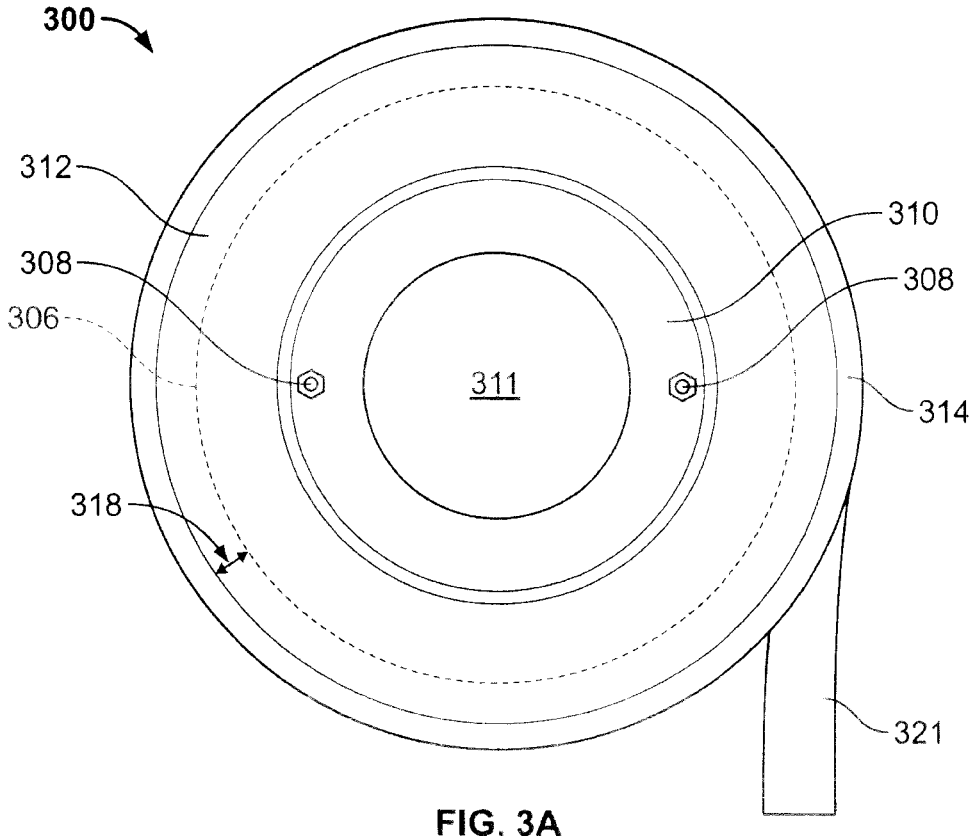
FIG. 3A is a plan view of an example burner including a vaporizer plate.
Figure 3B:
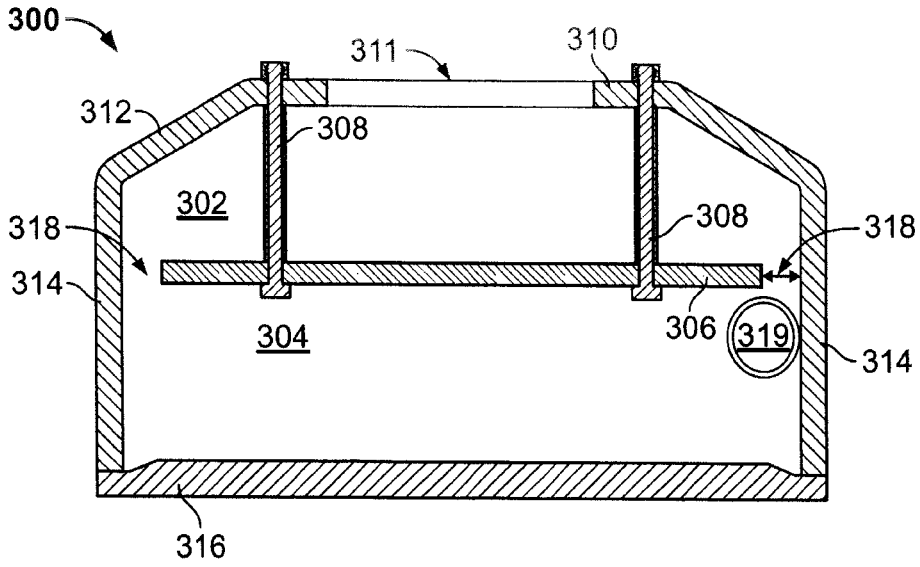
FIG. 3B is a cross-sectional side view of the example burner of FIG. 3A.

Referring to FIGS. 3A and 3B, a plan view and cross-sectional side view of an alternative implementation of a burner 300 are shown. In this implementation, the combustion chamber is separated into an upper chamber 302 and a lower chamber 304 by a vaporizer plate 306. In this example, the vaporizer plate 306 is suspended by two or more support members 308 from an upper wall 310 of the burner 300. In other implementations, the plate 306 can be supported by one or more support members extending from the interior lower surface 316 of the burner, or one or more radial support members extending to the side wall 314.

In this implementation, the upper wall 310 includes a slanted portion 312 extending toward a cylindrical side wall 314. The cylindrical wall 314 joins the lower wall 316 to enclose the upper and lower combustion chambers 302, 304.

An annular gap 318 is provided between the vaporizer plate 306 and the cylindrical wall 314, thereby providing fluid communication between the upper and lower chambers 302, 304. In this implementation, the air entrance 319 from the air inlet 321 delivers the air stream into the lower chamber 304. Similarly, the fuel is provided upstream of the air entrance 319 into the air stream, and therefore the air/fuel mixture first encounters the lower chamber 304. The plate 306 can be formed from a heat resistant material, for example, stainless steel or ceramic although other material can be used. The heat within the lower chamber 304 can heat the plate 306 to glow red hot, for example, at a temperature in the range of approximately 650° C. to 825° C. The radiant heat emitting from the plate 306 along with the direct heat provided to unburned fuel contacting the surface of the plate 306 enhances vaporization of the fuel in the lower chamber 304. That is, the plate 306 increases the surface area the fuel within the burner of a given volume is exposed to and thereby improves the vaporization.

The dimensions of the burner 300 can vary, depending on the application. In one illustrative example, the burner has a 15 inch diameter and is 8 inches tall. The diameter of the exhaust port is 6⅝ inches and the walls of the burner are a ½ inch thick. The vaporizer plate is positioned 3½ inches above the lower wall. Other dimensions are possible, and these ones are but one example.

Figure 4A:
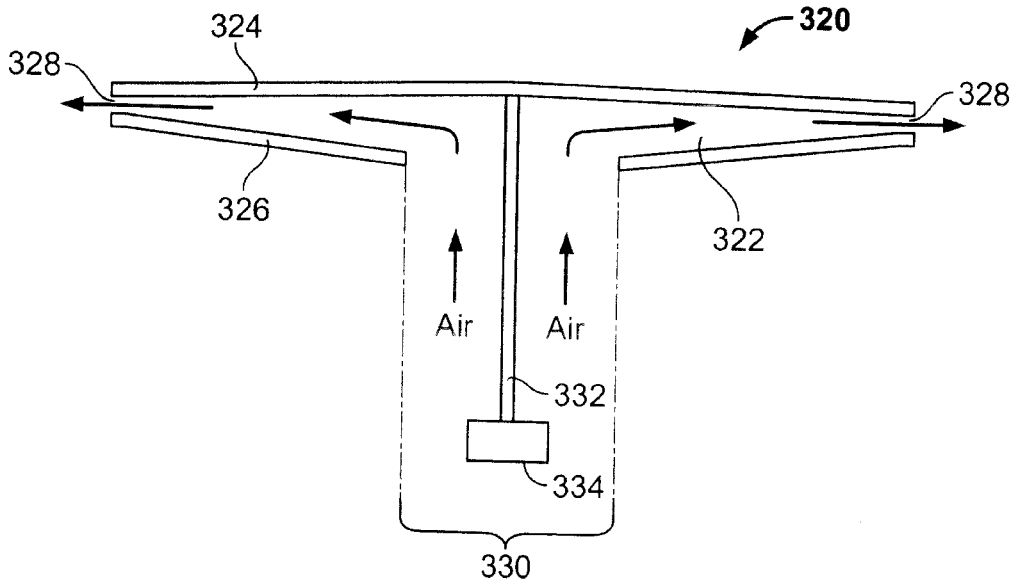
FIG. 4A is a cross-sectional side view of an alternative vaporizer plate.
Figure 4B:
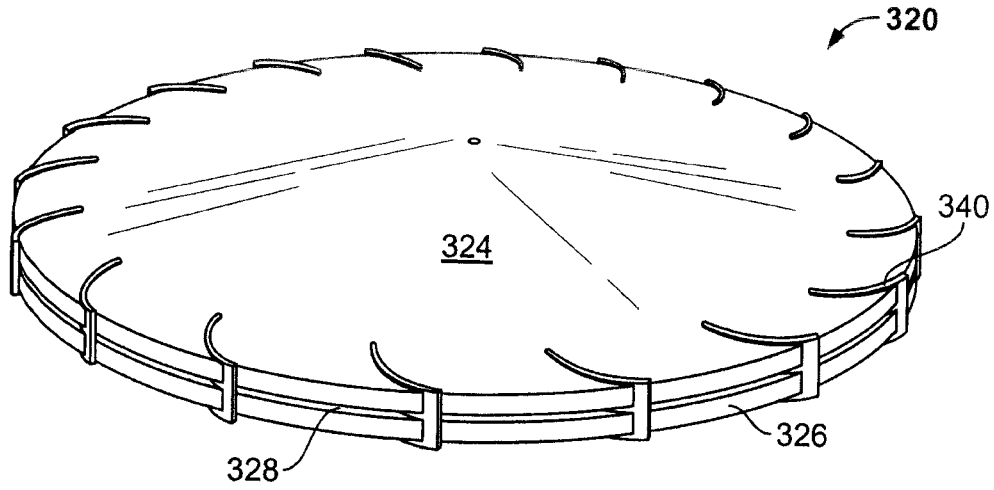
FIG. 4B is a perspective view of an upper surface of the alternative vaporizer plate of FIG. 4A.
Figure 4C:
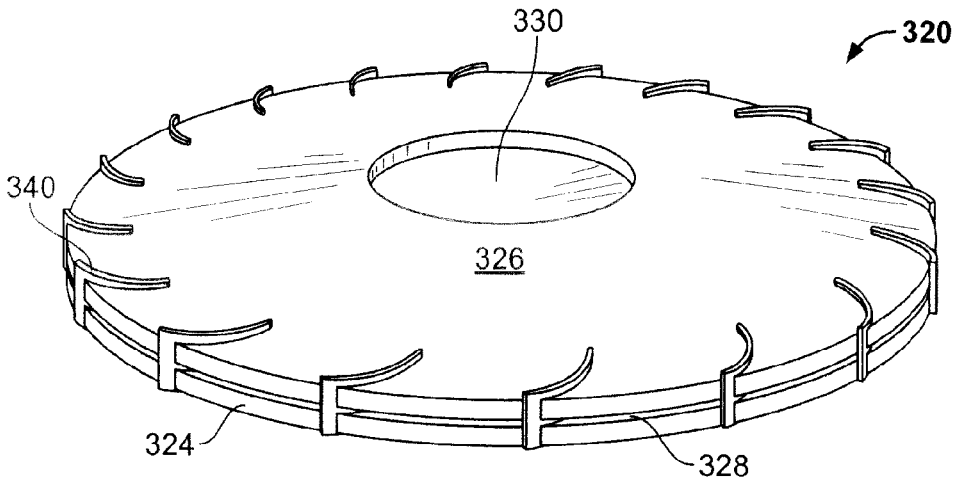
FIG. 4C is a perspective view of a lower surface of the alternative vaporizer plate of FIG. 4A.

Referring to FIGS. 4A-4C, a schematic representation of an alternative embodiment of the vaporizer plate is shown. FIG. 4A shows a cross-sectional side view, FIG. 4B shows a perspective top view, and FIG. 4C shows a perspective bottom view of the vaporizer plate 320. In this embodiment, the plate 320 is fluidly connected to a secondary gas (air in this example) supply and includes an annular gap 328 along the circumference of the plate 320 from which air can be directed into the upper and/or lower chambers 302, 304. In the example shown, the plate 320 is hollow and includes a void 322 between an upper plate 324 and a lower plate 326.

The plate 320 can be mounted to the inner surface of the lower wall 316 of the burner 100, for example, on a pedestal. The pedestal can include an air flow line to direct the secondary air supply into the plate in the region 330. Other configurations can be employed to mount the plate 320 within the burner 100. The air enters the void 322 and is directed out of the annular gap 328 into the combustion chambers 302 and 304.

Referring to FIG. 4B, a perspective view of the upper surface of the plate 320 is shown. Curved slots are formed in upper and lower plates 324, 326 and fitted with vanes 340 that direct air exiting the plate 320 into a rapid spiral flow. Preferably, the plate 320 is configured such that the vanes 340 are orientated to direct the air into the rapid spiral flow in the same direction as a primary air supply, i.e., air introduced from air supply 321 through air entrance 319. The air exits the plate 320 radially at a high velocity and mixes with fuel and air vapors and the flame present in the lower combustion chamber 304. The secondary air supply can be controlled separately from the primary air supply and can provide a cooling function to the plate 320. FIG. 4C shows a perspective view of the lower surface of the plate 320. The lower surface can include an open region 330, which can be enclosed when the lower plate 326 is attached to a pedestal on which the plate can be mounted to the lower wall of the burner.

In other implementations, more or fewer vanes 340 can be included in the plate 340, and the vanes can be configured differently than shown. For example, the curvature can be different than in the example shown, and/or the length of the vanes can be different.

In some implementations, the upper and lower plates 324, 326 are both approximately 6.5 millimeters thick and made of metal, for example, stainless steel, and the annular gap is approximately 2 millimeters in height. The vanes 340 can be formed from metal as well, for example, stainless steel. Other dimensions and materials are possible and those described here are for illustrative purposes.

Referring again to FIG. 4A, in some implementations, optionally ultrasonic energy can be transmitted to the vaporizer plate 320. An ultrasonic transducer 334 can provide ultrasonic transmissions to a transmission rod 332 that is positioned in approximately the center of the plate 320. The transmission rod 332 transmits ultrasonic energy to the plate 320 causing the plate to vibrate at a selected frequency. Vibrating the plate 320 can have beneficial effects on the combustion process. The transmission rod 332 can be encased within an air feed conduit providing air to the plate 320, and thereby be protected from the heat within the burner by the air flow within the tube.

Figure 4D:
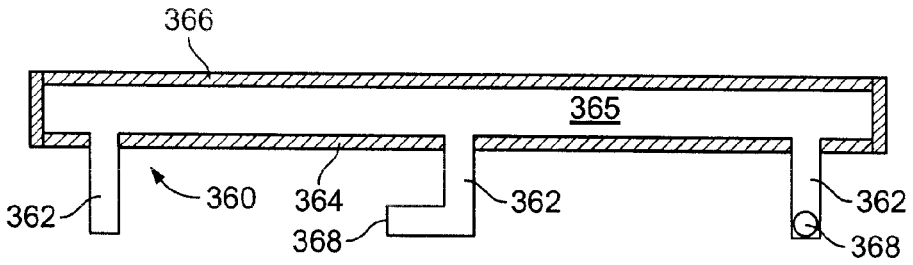
FIG. 4D is a cross-sectional side view of another alternative vaporizer plate.

Referring to FIG. 4D, another alternative implementation of a vaporizer plate 360 is shown. In this implementation, air directing members 362 are positioned under apertures formed in a surface of the plate 360. In this example, the apertures are formed in the lower plate 364, although in other implementations, the apertures can be formed in the upper plate 366 or both plates. The air directing members 362 can have different configurations, depending on the desired air flow pattern. In this example, each air directing member 362 is formed as a 90° elbow, with the air outlets 368 directing the air stream in substantially the same direction as the air is delivered into the lower chamber 304 through the air entrance 319, thereby enhancing the vortex action of the air flow within the combustion chamber.

Providing additional air flow into the combustion chamber by way of the vaporizer plate can provide a mechanism whereby the flame characteristics can be improved at a later stage of combustion by providing an oxygen rich zone that can enhance complete or substantially complete fuel burnout. In turn, the excess oxygen can facilitate the conversion of nitrogen oxide (NO) to nitrogen ($N_2$).

In some implementations, more than one vaporizer plate can be used to separate the combustion chamber into three or more chambers. For example, successive horizontal chambers can be formed between vaporizer plates. The successive chambers can be used to burn either the same primary fuel, or different fuels at the same time (e.g., the primary fuel and one or more secondary fuels), separately, or in sequence. By way of illustrative example in a three-chambered implementation, bitumen can be burned in a bottom chamber, a Number 6 fuel oil burned in a middle chamber and a diesel fuel or biodiesel fuel in an upper chamber. In other implementations, a secondary fuel can be burned in a single-chamber burner at the same time as the primary fuel.

Fuel Rake Assembly

In implementations of the burner using a primary fuel delivered into the combustion chamber in a solid or semi-solid phase, a fuel rake provided within the combustion chamber can facilitate air/fuel mixing and enhance the burn efficiency. For example, if the primary fuel is an oil sands product, the fuel (e.g., heavy oil or bitumen) may be contained within sand and/or clay. The fuel-containing sand or clay can be ground or pulverized and blended to produce a somewhat homogeneous feedstock of primary fuel.

Figure 5A:
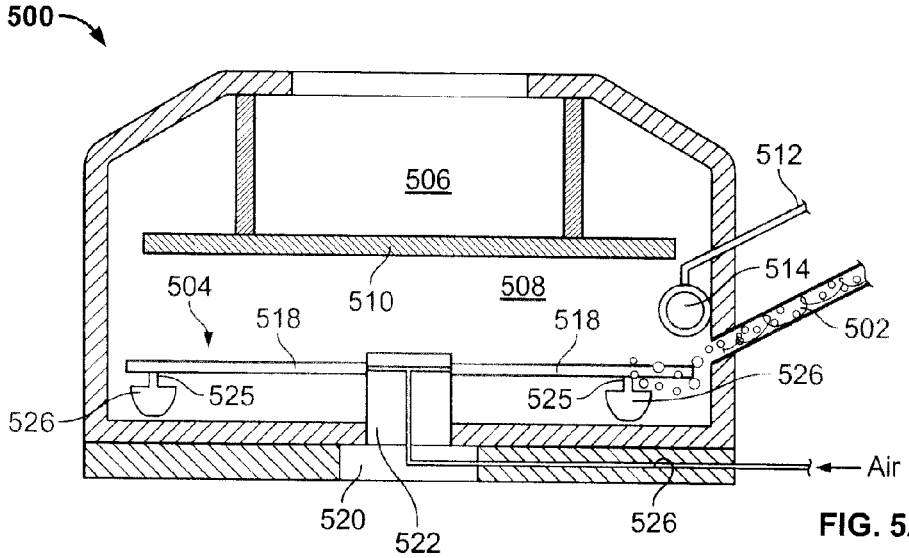
FIG. 5A is a cross-sectional side view of an example burner including a rake assembly.

FIG. 5A shows a cross-sectional view of an example burner 500 including a primary fuel delivery system 502 and a rake assembly 504. In this example, the burner 500 includes a combustion chamber separated into an upper chamber 506 and a lower chamber 508 by a vaporizer plate 510. However, it should be understood that the rake assembly can be used in other implementations that do not include the vaporizer plate 510, that include more than one vaporizer plate and/or that include a differently configured vaporizer plate 510.

A pilot fuel delivery system 512 is included for delivery of the pilot fuel into the air stream being delivered into the lower chamber 508 through the primary air inlet 514. In the implementation shown, the primary fuel delivery system 502 includes an auger to deliver the primary fuel feedstock into the lower chamber 508. Other configurations of primary fuel delivery systems can be used. The force of the air stream and the cyclonic air action within the lower chamber 508 cause the primary fuel feedstock to swirl about within the lower chamber 508. The heat within the lower chamber 508 as well as the high temperature of the walls and vaporizer plate 510 vaporizes the primary fuel contained within the feedstock. However, some of the feedstock in addition to non-combustible matter, e.g., sand or clay with the fuel burned from it, can accumulate on the inner surface of the lower wall 516 of the lower chamber 508.

In this implementation, the rake assembly 504 rotates about the center of the lower wall 516 of the lower chamber 508. The rake assembly 504 includes blades 518 configured to reach substantially to the inner surface of the lower chamber 504. In one example, the rake assembly 504 can be rotated (in the direction of arrow 505) at a low speed, e.g., 10 to 15 revolutions per minute (RPM) by a rotation mechanism 520 positioned underneath the burner 500. In one embodiment, the rake assembly 504 rotates by way of a geared chain and sprocket electric drive, although other rotation mechanisms can be used. For example, a low-geared motor can drive the vertical drive shaft 522 to rotate the rake assembly 504 at a suitable speed. In some implementations, a relatively low speed, e.g., 5-50 revolutions per minute, is appropriate.

Figure 5B:
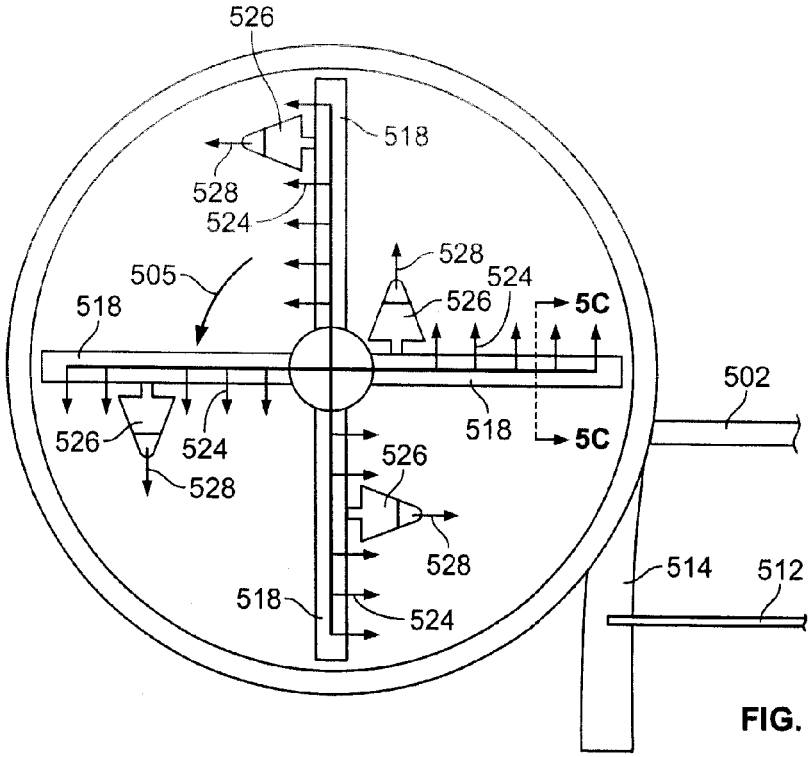
FIG. 5B is a cross-sectional top view of the burner of FIG. 5A.
Figure 5C:
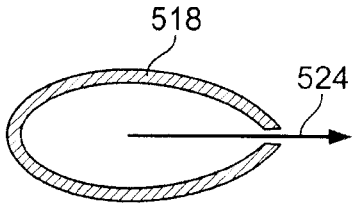
FIG. 5C is a cross-sectional view of a blade included in the rake assembly shown in FIGS. 5A and 5B.

The rake assembly 504 includes blades 518 that can be airfoil shaped, as shown, in the cross-sectional view of a blade 518 in FIG. 5C, or can have a different configuration. In an implementation that is pressurized and cooled with combustion air, air jets can be provided on the blades, or a continuous narrow air slot can be provided, in the leading edge of the blades 518, blowing air in the same direction as the primary air inlet 514. The direction of air flow through and out of the blades 518 is represented by arrows 524.

Referring to FIG. 5B, in some implementations, attached to the bottom of the blades 518 at various intervals can be short vertical tubes 525 terminating in scrapers 526, which may or may not be supplied with pressurized air. For example, as shown, the scrapers 526 can be each configured as a substantially triangular member with an air outlet directing air into the combustion chamber as represented by arrows 528. The scrapers 526 can further facilitate raking and agitating any accumulations of sand, clay (whether including unburned primary fuel or not) in the bottom of the lower chamber 508. Supplying pressurized combustion air to the accumulations can facilitate releasing the primary fuel from the accumulations of sand or clay to be vaporized and burned higher within the combustion chamber. In the implementation shown, the scrapers 526 are staggered at different radial distances along the four blades 518, such that the circular paths traced by the scrapers 526 together cover all, or substantially all, of the inner surface of the lower wall of the burner 500. That is, the entire surface of the lower wall is scraped by the combined effect of the four scrapers 526. In some implementations, the scrapers 526 can be configured to lift and turn to vigorously agitate unburned primary fuel deposited on the inner surface of the lower wall of the burner, thereby exposing the unburned fuel to the air supply and enhancing the complete burning of the fuel.

Figure 5D:
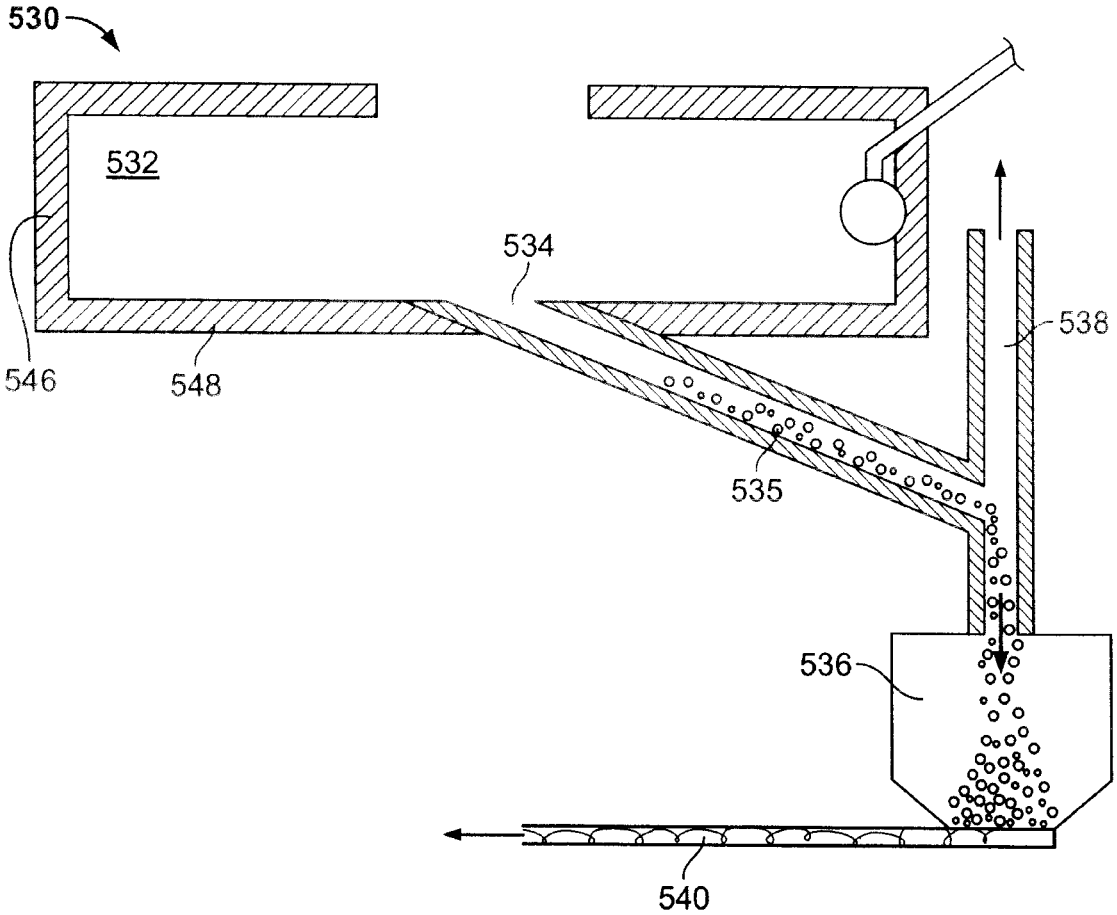
FIG. 5D is a cross-sectional side view of a burner including a chute.

Referring to FIG. 5D, a cross-sectional side view of an implementation of a burner 530 including an optional ejection system for spent non-combustible matter is shown. In this example, the ejection system is positioned in a lower, inner corner of the lower chamber, where non-combustible spent particles can be found traveling about the inner periphery of the lower chamber at high velocity. A chute 534 is provided to receive and trap the spent particles 535 as they travel about the outer periphery. The particles can be collected, e.g., in a hopper 536, and later disposed of, for example, by an auger 540. Optionally, the gases received in the chute can be re-injected into the burner through a vapor return duct 538.

Figure 5E:
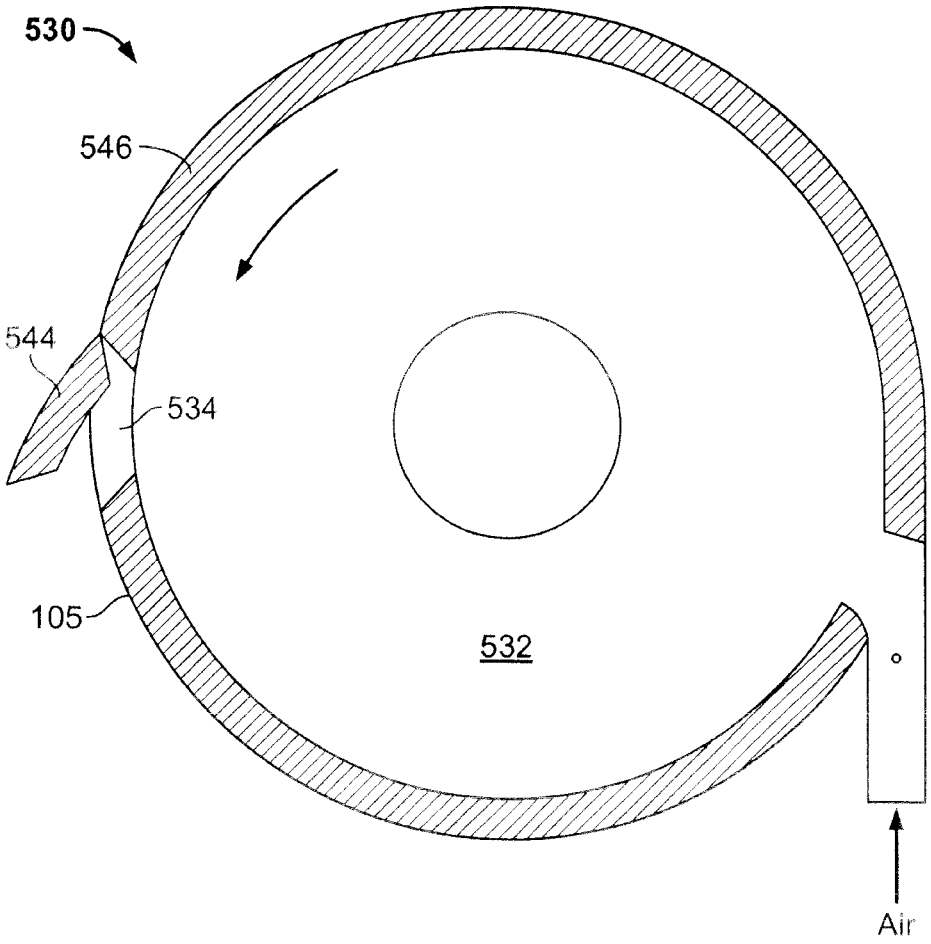
FIG. 5E is a top view of the burner of FIG. 5D.

FIG. 5E shows a top view of the burner 530 shown in FIG. 5D. In the implementation shown, an optional door 544 can be formed in the cylindrical wall 546 of the burner 530 that can pivot between an open and a closed position. In the open position, the non-combustible spent particles can be received in the chute 534. In the closed position, the chute 534 is not in communication with the combustion chamber 532. Preferably the height of the door 544 would be less than the total height of the cylindrical wall 546. For example, the door 544 can have a relatively short height and be located where the cylindrical wall 546 meets the lower wall 548 of the burner 530.

Figure 5F:
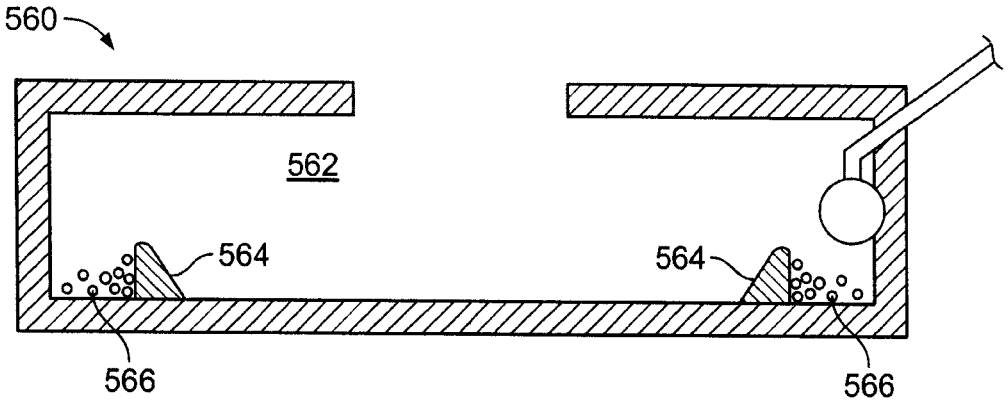
FIG. 5F is a cross-sectional side view of an alternative burner.

Referring to FIG. 5F, a cross-sectional side view of an implementation of a burner 560 is shown. In this implementation, a sloped ridge 564 can be included on the lower surface of the combustion chamber 562 to help separate the accumulations 566 containing unburned primary fuel (e.g., sand, clay, or silt) from those that are spent; the accumulations 566 tend to be heavier and therefore moving at a slower velocity than the spent non-combustible material. The ridge 564 can help to prevent exhausting unspent material that retains some primary fuel value. In other implementations, to facilitate separation of accumulations from the gases within the chamber, the lower wall of the burner can be configured in a convex or concave manner, so as to direct accumulations to a certain location within the chamber, where they can they be removed.

Boiler Application

Figure 6A:
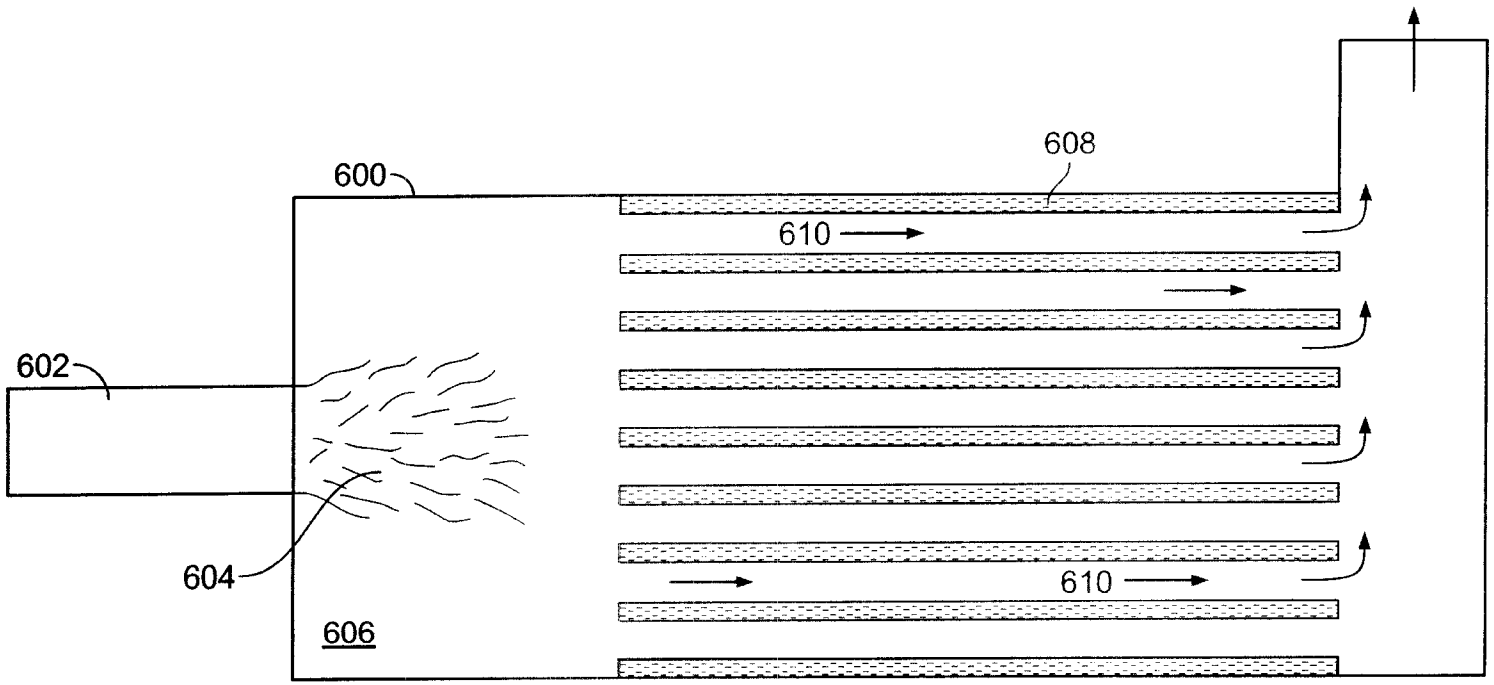
FIG. 6A (Prior Art)
FIG. 6A is a cross-sectional side view of a prior art example of a boiler.
Figure 6B:
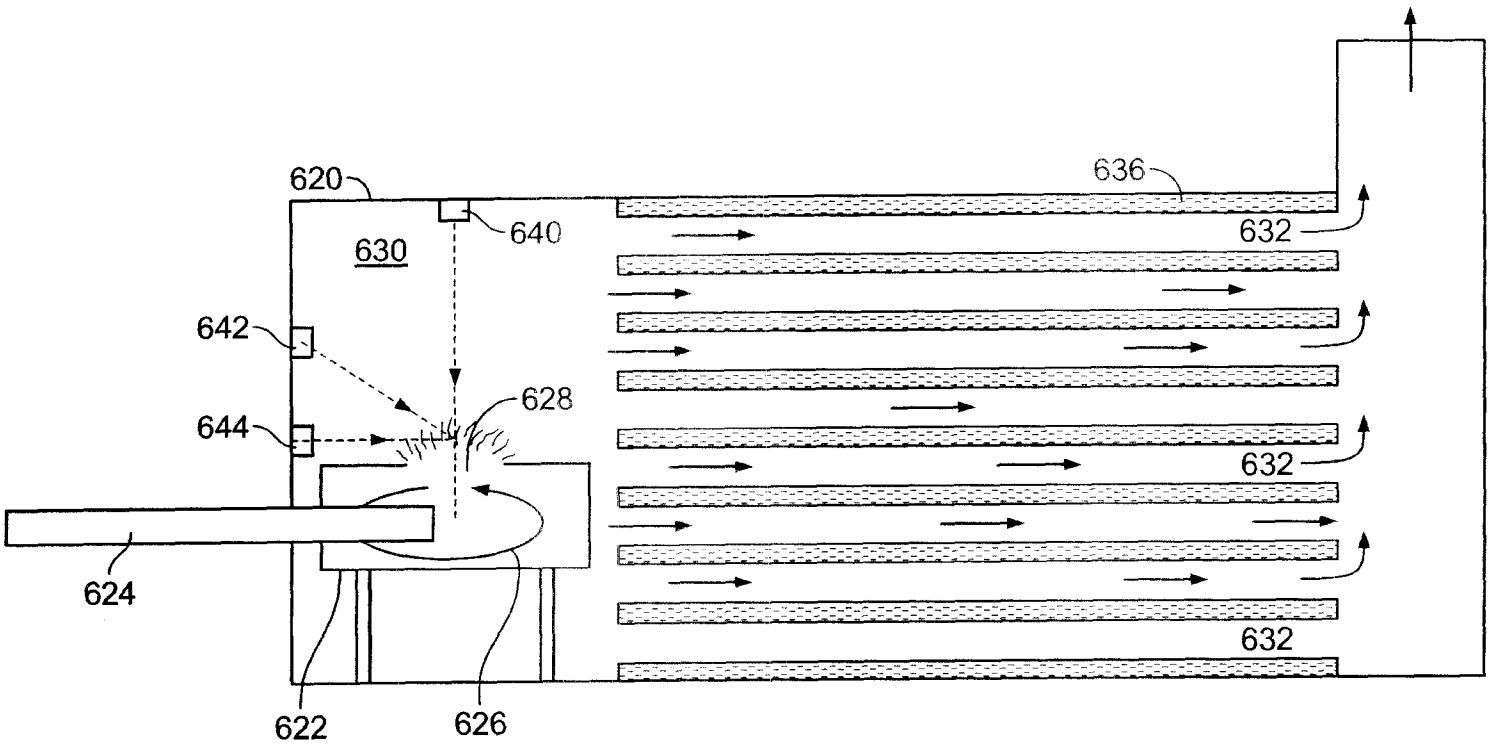
FIG. 6B is a cross-sectional side view of a boiler using a burner within the firebox.

Referring to FIG. 6A, a schematic representation of a prior art boiler 600 is shown. The boiler 600 includes boiler tubes 608 through which hot gases flow to heat and boil water surrounding at least some of the boiler tubes 608; the water and/or steam is indicated by 610. In one example, the water level is approximately ⅔ the height of the boiler tubes and steam collects in the upper portion of the vessel; for simplicity the water and steam are both depicted as 610. A burner unit 602 is external to the firebox 606. The flame 604 initiates in the burner unit 602 and projects into the firebox 606. The flame 604 heats the firebox and the flame's exhaust gases heat the boiler tubes 608, in turn heating and boiling the water. Typically, as shown in this example, the face of the burner unit 608 is flush with the interior surface of the firebox 606 and once the flame enters the firebox 606, any sort of flame management is difficult. Additionally, the flame is typically an orange or yellow flame that produces particles of incandescent carbon in the gas exhaust stream, creating carbon deposits in the boiler tubes and flues. This carbon coating can act as an insulator and greatly reduce boiler efficiency with even a thin deposit on boiler tube surfaces.

Referring to FIG. 6B, a schematic representation of a boiler 620 using a burner 622 as described herein is shown. In this boiler 620, the burner 622 is positioned within the firebox 630 itself, rather than external to the firebox. For example, the burner 622 can be configured similar to the burner 100 shown in FIGS. 1A and 1B, burner 300 in FIGS. 3A and 3B or burner 500 in FIGS. 5A and 5B. The burner 622 provides both radiant heat emitting from the surfaces of the burner 622 and convection heat provided by the exhaust gas. Advantageously, because the burner 622 provides radiant heat to the firebox, the heat emitted by the burner 622 can be determined based on the dimensions of the burner 622, and accordingly an appropriately sized burner 622 can be selected for the particular boiler 620. The flame is substantially contained within the burner 622. Air and fuel metering for the burner 622 can be housed outside of the firebox 630, allowing for control of the air and fuel inlet during operation. An example air inlet 624 is shown, as well as the swirling motion of air and fuel within the burner, depicted by the arrow 626. The flow of water and steam is illustrated by arrows 632 and the boiler tubes are represented by tubes 636.

Because the burner 622 burns with a clean flame 628, i.e., is a high energy flame, and there are substantially reduced particles included in the exhaust gas. Eliminating the exhaust of incandescent carbon that creates carbon deposits on the boiler tubes improves the efficiency of the boiler 620 and reduces the down-time of the boiler 620 required for cleaning and removal of such carbon deposits. Additionally, excess tube heating and destruction caused by hotspots from slag or other deposits can be avoided.

A boiler configured with the burner 622 within the firebox can be used in various different applications, including residential water heaters, commercial boilers, ship power plants, and the like. In some implementations, the burner and all contiguous control apparatus can be mounted on a skid mount or wheeled "tray" that can be unattached at a boiler wall mounting flange (for example) and the entire apparatus rolled out of the firebox so a replacement burner can be rolled into place. This can provide for quick and efficient replacement of a defective burner or a burner requiring maintenance or replacement, thereby minimizing downtime of the boiler when maintenance is required.

Oil Sands Application

There are several techniques to recover heavy oil or bitumen from oil sands that require steam generation. Cyclic Steam Stimulation (CSS) is an example of a thermal recovery process requiring steam. A volume of high pressure steam is injected through an injection well into an oil sands formation to heat the bitumen. The steam is generally injected at pressures above the fracture pressure of the reservoir, so a steam fracture is formed in the reservoir during injection. The reservoir may be allowed to "soak", during which the steam condenses and releases its latent heat to the formation thus further heating the oil sands. The injection well is then switched to a production well and reservoir fluids including steam, condensed steam, mobile bitumen, and gas are produced to the surface. The production stage continues while economic rates of bitumen recovery are achieved. After the bitumen rate becomes too small for the process to be economic, the well is switched to injection and the steam injection step starts again.

Steam Assisted Gravity Drainage (SAGD) is a second example of steam assisted bitumen recovery. Typically, two horizontal wells are drilled substantially parallel to each other in a heavy oil or bitumen reservoir, with one well positioned vertically above the second well. The upper well is the injection well and the lower well is the production well. Steam is injected through the upper well and forms a vapor phase chamber that grows within the reservoir. The injected steam reaches the edges of the depletion steam chamber and delivers latent heat to the surrounding oil sand. The oil within the oil sand is heated and, as its viscosity decreases, the oil drains under the action of gravity within and along the edges of the steam chamber toward the production well. The reservoir fluids, i.e., the heated oil and condensate, enter the production well and are motivated, either by natural pressure or by a pump, to the surface.

A variant of SAGD is the Steam and Gas Push (SAGP) process. In SAGP, steam and a non-condensable gas are co-injected into the reservoir, and the non-condensable gas forms an insulating layer at the top of the steam chamber. The well configuration is the same as the standard SAGD configuration. There are other examples of processes that use steam with different well configurations to recover heavy oil and bitumen.

The steam assisted bitumen recovery techniques described above, as well as others, typically use a boiler to generate the steam. A boiler configured to use the burner described herein, e.g., the burner 100 of FIGS. 1A and 1B burner 300 of FIGS. 3A and 3B or burner 500 of FIGS. 5A and 5B, can be used in these applications to efficiently generate steam. Additionally, hydrocarbon products produced by way of the bitumen recovery operation can be used as a primary fuel in the burner. For example, bitumen, oil sands crude or asphaltines can be used within the burner as the primary fuel. Conventional burner units for boilers are not able to burn bitumen. However, due to the high temperatures reached within the burner and the fuel vaporization resulting from the cyclonic action within the burner wherein unburned fuel is vaporized when contacting the heated interior walls of the burner, bitumen can be used as a viable primary fuel. Being able to use as fuel a product recovered during the bitumen recovery operation, as compared to say a more expensive option such as natural gas, can further improve the efficiency of the steam generation operation.

If using bitumen, that is, heavy oil separated from the sand, clay and/or silt of the oil sands, the bitumen can be used without any further processing. Preferably, the bitumen is pre-heated, for example, to approximately 315° C. to lower the viscosity and/or pre-mixed with a fluid such as water. For example, in some implementations, the bitumen is ultrasonically mixed in a 70% bitumen and 30% water ratio before being used as the primary fuel. Using one or more ultrasonic nozzles to inject the bitumen into the burner can also improve the burner's performance.

In some implementations, byproducts from upgrading the bitumen can also be used as a primary fuel. For example, coke is a solid carbonaceous material derived from destructive distillation of low-ash, low-sulfur bituminous coal. The coke can be ground to a powder before using as the primary fuel.

Heavy oils can be burned as the primary fuel. Some non-limiting examples include #6 fuel oil and Bunker C oil, which are oils commonly burned in boilers and power plants. However, burning them in the burner described herein is a clean burn, and therefore advantageously has cleaner emissions and improved efficiency. In some implementations, $CO_2$ emissions from the burner can be routed underground.

In addition to the example implementations described above, the burner can be used in any application requiring a heat source, of which some non-limiting examples include: on board a ship: any boiler plant for industry and/or large institutions: any heating system using hydrocarbon fuel in a liquid or semi-solid state, e.g., a home furnace or boiler. The size and output can be broad ranging, for example (and without limitation), from a 50,000 BTUH home boiler to a 50,000,000 BTUH SAGD steam generator. In addition to steam generation, the exhaust gas from the burner can be clean and particulate-free enough to directly power a wide range of gas turbines.

A number of embodiments of the invention have been described. Nevertheless, it will be understood that various modifications may be made without departing from the spirit and scope of the invention. Accordingly, other embodiments are within the scope of the following claims.

The invention claimed is:

1. A burner comprising:

a casing comprising a lower wall, an upper wall and a cylindrical side wall formed between the lower and upper walls and enclosing a combustion chamber;

the combustion chamber;

a plate separating the combustion chamber into an upper chamber and a lower chamber, with an annular gap between the plate and the cylindrical wall providing communication between the lower and upper chambers;

the plate including one or more apertures, each aperture being in fluid communication with a gas supply and wherein gas is provided to the combustion chamber through the one or more apertures;

a tangential gas inlet formed in the cylindrical wall of the combustion chamber;

a fuel delivery system configured to deliver fuel into the tangential air inlet; and an exhaust port formed in the upper wall of the combustion chamber;

wherein gas is delivered into the combustion chamber at a velocity and flow rate and mixes with fuel delivered from the fuel delivery system such that a clean flame burns in the combustion chamber, where a clean flame is substantially free of unburned particulate matter.

2. The burner of claim 1, wherein the fuel delivery system is configured to deliver fuel into a gas stream in the tangential gas inlet upstream of a gas entrance into the combustion chamber.

3. The burner of claim 1, wherein the exhaust port includes a sleeve extending substantially perpendicularly relative to the upper wall of the combustion chamber.

4. The burner of claim 1, wherein a width of the combustion chamber is at least two times a height of the combustion chamber.

5. The burner of claim 1, wherein a width of the exhaust port is in the range of approximately ¼ to ⅓ a diameter of the combustion chamber.

6. The burner of claim 1, wherein the fuel delivery system includes a nozzle to spray the fuel into the tangential inlet.

7. The burner of claim 1, further comprising:

a second fuel delivery system configured to delivery a primary fuel downstream of the fuel delivered by the fuel delivery system, wherein the fuel delivered by the fuel delivery system is a pilot fuel.

8. The burner of claim 7, wherein the primary fuel is gravity fed into the combustion chamber and the second fuel delivery system comprises a conveying system.

9. The burner of claim 1, wherein the gas delivered into the combustion chamber is air.

10. The burner of claim 1 wherein the tangential gas inlet terminates in an air entrance into the lower chamber.

11. The burner of claim 1 wherein the one or more apertures are formed in a lower surface of the plate and gas is provided into the lower chamber of the combustion chamber.

12. The burner of claim 1 further comprising one or more gas directing members positioned on the lower surface of the plate over each of the one or more apertures, the gas directing members providing a channel with an outlet to direct the flow of gas from the apertures into the combustion chamber.

13. The burner of claim 12, wherein each gas directing member comprises a first component extending substantially perpendicular to the plate and a second component extending substantially parallel to the plate where a distal end of the second component comprises the outlet.

14. The burner of claim 1 further comprising a second plate positioned between the plate and the lower wall of the combustion chamber with an annular gap between the second plate and the cylindrical wall, where the second plate separates the lower chamber into a first lower chamber and a second lower chamber.

* * * * *